US005351657A

United States Patent [19]

Buck

[11] Patent Number: 5,351,657

[45] Date of Patent: Oct. 4, 1994

[54] MODULAR POWER UNIT

[76] Inventor: Erik S. Buck, 1106 Lipton La., Dayton, Green County, Ohio 45430

[21] Appl. No.: 951,766

[22] Filed: Sep. 28, 1992

[51] Int. Cl.[5] ..... F02B 57/00

[52] U.S. Cl. ..... 123/43 C; 123/43 AA; 418/68; 418/164

[58] Field of Search ..... 123/43 R, 43 A, 43 AA, 123/43 C, 207; 417/461; 418/1, 68, 161, 164

[56] References Cited

U.S. PATENT DOCUMENTS

| | | | |
|---|---|---|---|
| 974,853 | 11/1910 | Bock . | |
| 1,053,799 | 2/1913 | Eslick | 123/43 A |
| 1,625,841 | 4/1927 | Wright | 123/43 A |
| 2,316,107 | 4/1943 | Ruben | 418/68 |
| 3,508,530 | 4/1970 | Clawson | 123/207 |
| 3,750,630 | 8/1973 | Hariman | 418/68 |
| 3,809,030 | 5/1974 | Moiroux . | |
| 3,893,433 | 7/1975 | Demetrescu . | |
| 3,994,632 | 11/1976 | Schreiber . | |
| 4,136,647 | 1/1979 | Stoler . | |
| 4,336,686 | 6/1982 | Porter . | |
| 4,407,239 | 10/1983 | Wass . | |
| 4,408,577 | 10/1983 | Killian . | |
| 4,421,073 | 12/1983 | Arregui et al. . | |
| 4,653,438 | 3/1987 | Russell . | |
| 4,779,579 | 10/1988 | Sukava et al. . | |

FOREIGN PATENT DOCUMENTS 0348247 2/1922 Fed. Rep. of Germany ..... 417/461

*Primary Examiner*—Richard A. Bertsch
*Assistant Examiner*—Charles G. Freay
*Attorney, Agent, or Firm*—Joseph G. Naumann

[57] ABSTRACT

A rotary power device of modular construction is disclosed in which one or more pistons are reciprocably received in a cylinder sleeve, and the sleeve is rotatably supported in a bore within a housing. A cam and follower mechanism acting between the housing and piston governs reciprocating motion of the piston(s) within the sleeve. Rotary power can be extracted from the sleeve, or reciprocating power can be extracted from the piston(s). The rotating cylinder functions as a sleeve valve and permits, depending on the porting, use of the device as a gas-expansion engine (e.g. steam or compressed air) or pump, or as a two-stroke or four stroke internal combustion engines using spark or compression ignition. Engines built according to the invention are simples, compact, and can be perfectly balanced, and multiple engine modules may be coupled together in various configurations to form power plants of various sizes.

11 Claims, 6 Drawing Sheets

MODULAR POWER UNIT

FIELD OF THE INVENTION

The invention relates to forms of rotary power device in which the piston(s), cylinder, and output shaft all rotate, coaxially, relative to a surrounding stationary housing. A device of this construction is capable of use as a gas-expansion engine or pump, deriving or imparting power from/to a fluid (ego steam or compressed air), and also can be designed as an internal combustion engine, either two-stroke or four stroke. Spark ignition or compression ignition may be used in the I.C. engine versions, and these engines are well suited for multi-fuel use. Rotary or reciprocating output, directly from one or more pistons, can be provided. The engine can be constructed in modules, and several modules may be joined for increased output.

BACKGROUND OF THE INVENTION

Within the general class of reciprocating piston devices, there are countless mechanisms which accomplish the task of converting the pressure of expanding gas into rotary motion or, conversely, using a rotary input to pump a fluid. Statistically, pistons are most, commonly coupled to a rotating crank, via a connecting rod, but several engines have been known which use cams to couple the reciprocating motion of pistons to the rotary motion of a shaft. Similarly, while most such devices use a stationary cylinder and reciprocating pistons, there are several known designs, generally called rotary engines, in which the cylinders, or the pistons, or both, revolve. Likewise, the valves controlling the gas flow may be poppet valves, slide valves, rotary valves, sleeve valves, or simply ports which are covered and uncovered by the piston motion, as in the common two-stroke gasoline engine.

Sleeve valves themselves are well known, and have a number of recognized advantages, as compared to other types of valves in engines and pumps. A sleeve valve is simple, being formed by placing a port or ports in the wall of a moving sleeve which surrounds the reciprocating piston(s) and forms a cylinder. The sleeve usually is reciprocated in a circumferential direction, and its ports cooperate with related ports in the housing, thus requiring minimum additional parts, and the sleeve valve is not subject to inertial effects, such as the "valve float" experienced at high speed with reciprocably operating spring-loaded poppet valves and their associated actuating mechanisms.

However, it appears there has never been any recognition of the unique advantages which might be achieved by combining a sleeve valve controlled device using reciprocating piston(s) with a cam mechanism cooperating with the piston(s) to achieve timing and power extraction from the device.

SUMMARY OF THE INVENTION

The subject of this invention is a notably simple and compact device which may be described as rotary, in that the piston(s), cylinder sleeve, and output shaft or gear (which may be part of or directly coupled to the cylinder) all rotate around a common axis within the bore of a housing. The rotating cylinder also functions as a sleeve valve, covering and uncovering ports in the surrounding housing which contains the cylinder and the piston(s) within it. The reciprocating motion of the pistons is converted to rotary motion by the action of cam followers on annular cams which are also concentric to the axis of the device; preferably the cams are mounted to the housing and the followers are carried by the piston or pistons.

The followers are arranged such that forces acting between the follower and cam are balanced, so as to assure balance of the relative reactive forces between the housing and the captured piston(s) and to avoid an offset couple on the piston as it travels within the cylinder. A cross-head mechanism couples the piston(s) to the cam followers to the desired timed relative motion between piston and sleeve cylinder.

While the device can be built with a single piston, and a single lobe cam, a multi-lobed cam improves the rotational balance of the device, and with two or more pistons and multi-lobed cams the device can be made with substantial symmetry of the moving parts, resulting in dynamic balance without resort to counterweights or counter-rotating shafts. In a dual opposed piston device, separate cams are provided to control the reciprocating motion of each piston, and these cams can be of somewhat different configuration if desired to provide unique control capabilities in combination with corresponding sleeve valve porting and housing porting.

Further, the module is remarkably simple to construct and forms a very compact assembly, relative to its piston displacement. It is intended that the module may be used singly, as a relatively small engine or pump, or several may be coupled together to form a power plant of larger size. For this reason, the invention is described hereinafter as a "modular power unit."

The rotary motion, aided by the pressure fluctuations in the space on the cool side of the pistons assures a good distribution of lubricant/coolant such as oil. Wear is minimized, and wear can be reduced even further by adding an additional cam and cam follower to give the sleeve cylinder a small axial component of motion as well as the rotary component, or by having one piston and the sleeve integral, so the sleeve reciprocates as well as revolving. When the motion of the sleeve and the pistons is out of phase, the piston is never stationary with respect to the sleeve, and accelerated wear and corrosion is avoided at the point where the upper piston ring stops at top dead center, eliminating the so-called "ring ridge."

Notably, there also is no sideways thrust of the piston against the cylinder wall (the sleeve), nor of the sleeve against the housing; this feature further minimizes friction and wear.

In versions of the device forming the basis of internal combustion engines, in addition to controlling the intake and exhaust of the working fluids, the sleeve preferably also exposes and covers a small chamber external to the cylinder into which a fuel charge can be admitted. This chamber may be similar to the external chamber described in U.S. Pat. No. 4,996,953 entitled TWO PLUS TWO STROKE OPPOSED PISTON HEAT ENGINE, issued Mar. 5, 1991, but in that patent access from the chamber to the cylinder is controlled by piston motion, whereas according to the present invention the port to such fuel chamber is valve controlled. If the engine is carburetted, the chamber may be a simple receptacle for an ignition source, such as a spark plug or glow plug.

The valving action of a port in the rotating sleeved, covering or uncovering the ignition source at a desired timing, eliminates the need for an ignition distributor for timing ignition. If a form of fuel injection is desired, a relatively rich fuel-air charge can be pre-introduced into the chamber and then exposed to the hot compressed air in the chamber at a predetermined time before top dead center (TDC) to achieve a desired flame propagation in the engine cylinder by control of the sleeve port timing with respect to such chamber.

In a compression ignition (CI) engine, a conventional diesel injector can be placed in the receptacle. There is an advantage to such a configuration in that, when compression ignition is used, the combination of sleeve valve and external chamber eliminates the necessity of using a high pressure, timed fuel injection, as would be used in most CI engines. Fuel can be introduced into the chamber at relatively low pressure when the chamber is-isolated from the cylinder. The chamber can also be used to preheat the fuel, before it is exposed to the hot, compressed air of the cylinder toward the end of the compression stroke. Preheating the fuel reduces ignition delay. This combination of features greatly reduces the cost of manufacture, by eliminating a costly diesel fuel injection systems and it allows the modular power unit to use fuels which would not be suitable for a typical IC engines because, for instanced they are too viscous or abrasive to be effectively atomized by conventional high-pressure fuel injectors.

The combustion process in a compression ignition internal combustion engine version of the device is controlled generally as follows. Each intake stroke draws in a full charge of air regardless of power setting, so there is always excess of oxygen in the power cylinder. Fuel is introduced into the external fuel chamber at relatively low pressure (as compared for example to a conventional diesel engine) and the fuel is warmed to pre-burn conditions while separate from the combustion chamber and with little or no oxygen present. The fuel is vaporized and pyrolysed, and prepared to burn the instant sufficient oxygen is available. Since this occurs in a separate fuel chamber, there is no chance of pre-ignition, even though the compression ratio of the engine may be high. When heated compressed air from the combustion chamber is admitted to the fuel chamber (under valve control) mixing of fuel vapors and air is quick and thorough, so ignition occurs rapidly (as contrasted to fuel injectors where some short but finite time is required to heat fuel to ignition temperature). When ignition occurs, there is a sharp increase in pressure which will expel the remaining fuel from the fuel chamber into the combustion chamber under favorably turbulent conditions. This promotes clean and thorough combustion. A further advantage of the sleeve valve is that, by extending the cylinder sleeve as needed and simply providing additional apertures and ports, it can be used to control the flow of air and/or lubricants into or out of the "pumping space" on the cool or back side of the pistons. This pumping action, available without adding any new parts, may be used to motivate the intake charge of the two-stroke version or to provide a supercharging effects essentially doubling the mass of air valved into the cylinder in the four-stroke configuration. It should be noted that, in the two-stroke version, the sleeve valve can be arranged to open the exhaust ports before the intake ports are opened and close the exhaust before the intake ports close. This greatly improves the volumetric efficiency, as compared with typical two-stroke engines.

Certain loads, such as linear electric generators or pumps or "jack hammers" use a reciprocating motion, rather than a rotary movement. The modular power unit lends itself to coupling the reciprocating piston(s) directly (e.g. via a rod) to such loads without the need for conversion from reciprocating motion to rotary motion and back to reciprocating motion. For optimal simplicity and compactness, the driven device can be integrated into the engine module. For example, if strong permanent magnets are incorporated into the pistons and coils of wire are placed in or around the cylinder, an alternating electrical current will be generated very conveniently. If rotary power is desired, a gear or the like may be attached to an extension of the cylinder sleeve which projects beyond an end of the housing, whereby a rotating load can be coupled to the rotating sleeve. Thus, a feature of the design is its ability to provide either reciprocating or rotating output with little change in the basic module design.

For the same reasons, it is possible to couple together multiples of the modules, particularly for rotary output, and to regulate their power stroke relationships to achieve a more even power output from the joined modules.

Thus, the principal object of this invention is to provide methods, and corresponding devices for performing such methods, in which one or more pistons and a sleeve-like cylinder rotate together and coaxially, within a bore in a surrounding stationary housing, while the piston or pistons reciprocate within the cylinder sleeve through the action of a cam/follower mechanism coupled between the housing and piston(s), and in which the rotating cylinder sleeve and the housing have suitable porting functioning as a sleeve valve; to provide such methods and devices which facilitate use of the device as a gas-expansion engine (e.g. steam or compressed air), as a pump or compressor, or as an internal combustion engine, either two-stroke or four stroke, with spark ignition or compression ignition; to provide such an engine which is suited for multi-fuel use; to provide a simple fuel chamber mechanism which will function under control of suitable valving to supply a rich fuel charge susceptible to quick and even combustion when the chamber is opened to the combustion chamber of such engines; to provide such engines with either rotary shaft output or a reciprocating output; to provide multiple engine modules, in particular, which may be coupled together for increased output in a variety of assemblages.

Other objects and advantages of the invention will be apparent from the following description, the accompanying drawings and the appended claims.

DETAILED DESCRIPTION OF PREFERRED EMBODIMENTS

The Device Assemblage

Figure 1:
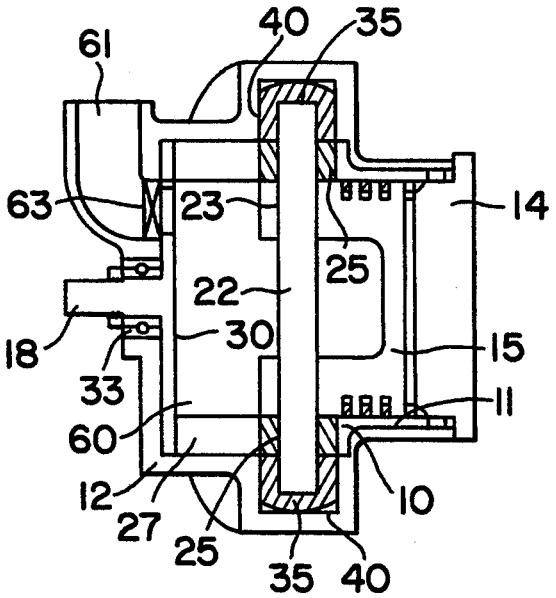
FIG. 1 is a longitudinal sectional view illustrating an elementary form of the invention, namely a single piston two-stroke device using a two-lobed cam.

The principal parts of the device are a sleeve-like cylinder 10 which is rotatably supported to move relative to and within a bore 11 in a housing 12. In the simplest embodiment (FIGS. 1–3) the cylinder contains a single piston 15 which reciprocates within cylinder 10 toward and away from a cylinder head 14 closing one end of the housing. Cylinder 10 and piston 15 rotate together within bore 11 in housing 12, and the cylinder is coupled to a shaft 18, which transmits a rotary output to or from the device.

The piston 15 is coupled to cylinder 10 through a crosshead assembly 20 which comprises a pin or rod 22 fitted into a transverse bore 23 in piston 15 (see FIG. 3) and receiving a pair of coupling blocks 25 that fit into elongated slots 27 in cylinder sleeve 10. The outer U-shaped member 30 of the crosshead assembly has slots 30A in its arms 30B which receive the outer parts of blocks 25, and output shaft 18 extends from the center of member 30 and is fitted through a central bearing 33 (FIG. 1) in housing 12. The reciprocating motion of the piston is determined by cam followers (preferably rollers) 35 fitted to the ends of pin 22 and which contact sinuous cam surfaces or slots 40 in the inner wall of housing 12. The elongation of cylinder slots 27 accommodates the relative reciprocating motion between the piston and cylinder, as blocks 25 move back and forth along slots 27.

The sinuous groove or cam 40 preferably should have two cycles per revolutions and a similar number of cam followers, so the forces on the piston are symmetric, and there is no couple tending to cock piston 15 in the cylinder/sleeve 10. Similarly, there are no significant forces tending to push piston 15 against the interior wall of cylinder 10, resulting in reduced wears as compared with an engine employing a crank and connecting rod coupled through a conventional wrist pin to a piston; in such conventional connecting rod arrangements, force components exist tending to tilt the piston with respect to the cylinder bore. In contrast, in the various versions of the present invention the crosshead and cam followers function as a large diameter bearing which keeps the piston and cylinder sleeve aligned within the housing bore.

It should be noted that, by providing two cam lobes and thus two cycles to the cam (e.g. the cam curve is $a\omega\sin 2\theta$), there will be two complete piston strokes for each revolution of the cylinder sleeve 10, giving the effect of a built-in 2:1 reduction in rotational speed for a given piston speed. It is possible to have more cam lobes and corresponding followers, distributed evenly around the housing, but in the interest of better design latitude for sleeve porting, a lower number of cam lobes appears to be preferred.

In FIG. 1, the piston is shown at top dead center (TDC). A charge of gaseous fluid is admitted into the cylinder through an intake port 50 in the housings which port is in turn controlled by oppositely located control ports 52A and 52B in rotating cylinder sleeve 10. An exhaust port 55 in the housing is also opened and closed by control ports 52A, 52B, to control the exhaust of the fluid from the cylinder.

In the case of a gas expansion device, such as a steam or compressed air engine, or in the case of a compressor, the length of ports 50, 52A and 52B, and 55 and their relative placement around the housing and sleeve, will be such as to achieve the most efficient intake, cut-off, and exhaust of the pressurized fluid delivered to the intake port. The particular placement and design of the ports is known to those skilled in the art of such devices. By way of example, pressurized fluid (steam or compressed air) can be supplied to a chamber 45 located exteriorly of housing 12 which is connected to port 55. This port is opened by sleeve control port 52A or 52B each time piston 15 is approximately at its top dead center (TDC) position; this occurs twice per revolution of cylinder sleeve 10. The length around the sleeve of ports 52A, 52B will determine the time of opening of intake port 50.

Figure 2:
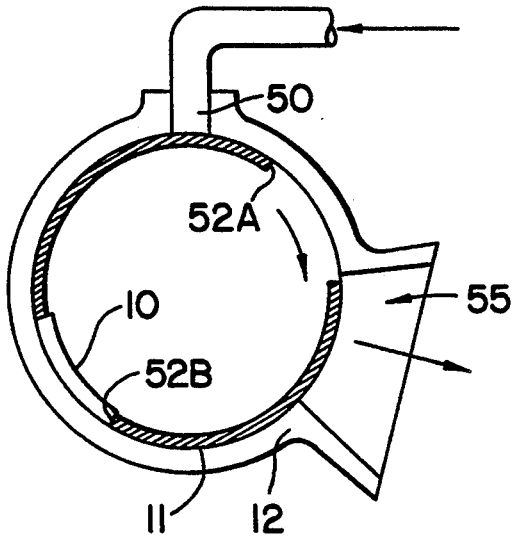
FIG. 2 is a transverse sectional on line 2—2 of FIG. 1 and illustrates the arrangement of the sleeve valve and ports in the sleeve valve and surrounding housing.
Figure 3:
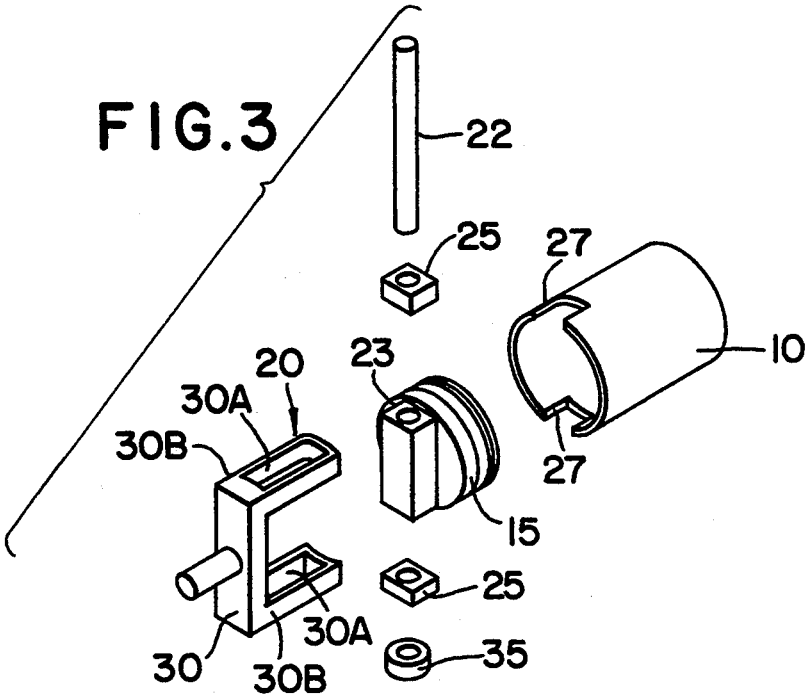
FIG. 3 is an exploded perspective view showing the major components of the device illustrated in FIGS. 1 and 2.

Exhaust port 55 will be opened by sleeve port 52A at or slightly before the bottom dead center (BDC) position of piston 15, about 90° clockwise from port 50 in FIG. 2. Expansion motion of the cylinder space between piston 15 and cylinder head 14 will result in rotation of the sleeve 10 and piston 15, since the two are coupled via the cross-head structure and the followers 35 will move along cam 40. As the piston moves past it top-dead-center position (the peak of cam 40) the cylinder space starts to decrease, exhaust port 55 will be opened to allow the expanded gas to depart the cylinder. As the piston and cylinder continue to rotate, exhaust port 55 will close, and then at or slightly after bottom dead center (BDC), the beginning of the second piston stroke, intake port 50 will be opened by port 52B to admit another charge of fluid.

The variable volume space 60 at the back of piston 15 can be utilized as either a pumping/compressing chamber or as a charging chamber for filling the main cylinder space between piston 15 and head 14. Thus, the end wall of housing 12 contains an inlet fitting 61 which extends to an inlet port 62 controlled by a suitable valve 63, which might for example be a rotary valve connected to the crosshead, or a check valve. As the piston moves toward the heads, the volume of space 60 behind piston 15 will increase, and fluid (e.g. air) can be drawn into that space. Then, as the piston reverses its motion, fluid in space 60 can be transferred to inlet port 50 via suitable conduit and a further check valve (not shown). Or, if the dimensions of piston 15, slots 27, and the cam/follower lift (corresponding to the piston stroke length) are properly arranged, fluid can be transferred from volume 60 via slots 27 and past the rim of piston 15 in its BDC position, into the primary volume of the device.

The device as above described can also function a pump or compressor, by driving shaft 18 with a suitable power source. For example, in such a pump port 55 would function as a fluid inlet, and port 50 as a fluid outlet. Rotating crosshead 20 will cause piston 15 to reciprocate as its followers 35 track cam surfaces 40, and the sliding block connection of the piston to sleeve 10 will cause the sleeve to rotate while accommodating the reciprocating motion of the piston, thereby providing the requisite sleeve valving.

Elemental Internal Combustion Engine

Figure 10:
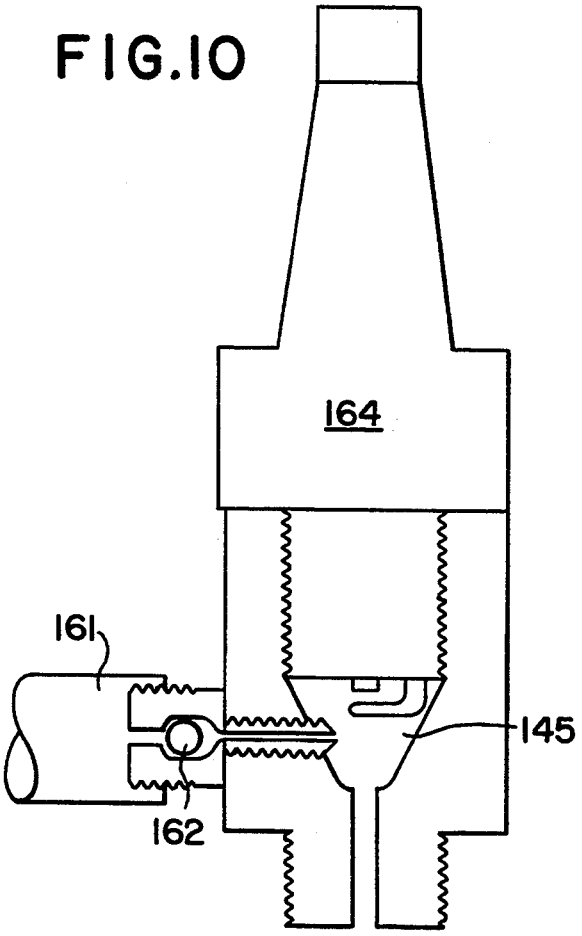
FIG. 10 is an enlarged view, essentially in cross-section, showing details of a fuel chamber arrangement.

In a simple single piston internal combustion engine version of the device (FIGS. 4 and 5), in addition to the previously described components of the device (to which similar reference numbers in the 100 series are applied) there is a form of external fuel chamber 145 which can communicate with a fuel port 150A when piston 115 is at or slightly in advance of its top dead center (TDC) location. Details of the fuel chamber are shown in FIG. 10.

There is a fuel inlet pipe 161 into which fuel is supplied via a check valve 162 (to prevent a reverse flow of the fuel) into chamber 145. Spark plug 164 can be fitted to the top of chamber 145 in the case of a spark ignition engine; in a compression ignition engine a glow plug can be fitted there. A suitable fuel pump such as a simple gear pump (not shown), provides a continuous fuel flow at moderate pressure to the fuel inlet pipe 161. Except for check valve 162 and pressure control (not shown), there are no other moving parts in the fuel system. This presents the option of using viscous or abrasive fuels which would not be suitable for use in conventional diesel injectors. Also, such a simple fuel system costs less to manufacture than the conventional close-tolerance diesel injector system.

Fuel can enter fuel chamber 145 whenever the fuel line pressure exceeds the internal fuel chamber pressure. The volume of fuel admitted, and therefore the power output of the engine, can be controlled by controlling the fuel line pressure. During the exhaust, intake, and compression strokes fuel may enter chamber 145 until the vapor pressure of the fuel equals the fuel line pressure. The incoming fuel is heated by the poorly cooled fuel chamber 145, so that much of the fuel is vaporized, but there is insufficient air in fuel chamber 145 to support combustion.

Preferably, the temperature should be high enough to partially pyrolyse the fuel, which greatly enhances ignition. Even though the fuel may be vaporized, pyrolysed, and at ignition temperature (three preconditions for proper combustion) combustion cannot take place until there is sufficient oxygen present.

When sleeve port 152 uncovers the fuel chamber port 150A toward the end of the compression stroke hot compressed air is injected into fuel chamber 145, providing oxygen to the hot fuel vapors already present therein. Ignition is prompt, followed by a rapid increase in temperature and pressure, and the burning fuel-air mixture is propelled through the ports into the cylinder, where complete combustion with an excess of oxygen occurs.

Figure 5:
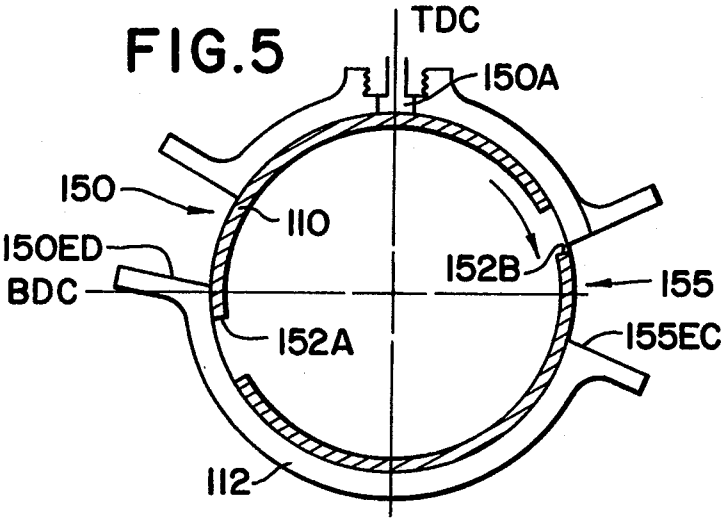
FIGS. 4 and 5 are views similar to FIGS. 1 and 2, showing a two-stroke internal combustion engine configuration of the device.

In FIG. 5, for purposes of reference it will be understood that the centers of the high points of the cam lobes will coincide with a vertical centerline (i.e. 0° and 180°), and the centers of the low points of the cam lobes will coincide with a horizontal centerline (i.e. 90° and 270°). Fuel port 150A is shown centered on 0°, and the opening edge of exhaust port 155 is a few degrees ahead of 90°. There is an intake port 150 which is spaced around the bore wall of housing 12, approximately opposite exhaust port 155 and counterclockwise from fuel port 150A, with its opening edge a few degrees past 270°. All three of these ports 150, 150A and 155 are controlled by ports 152A and 152B in sleeve 110. A charge of air (or a lean carbureted air-fuel charge) is admitted via intake port 150, which is then closed as the cylinder sleeve 110 rotates, so the intake charge is compressed by piston 115 as soon as intake port 150 is closed. The angular extent of ports 152A, 152B can vary but may be in the range of 10° to 15°.

Figure 4:
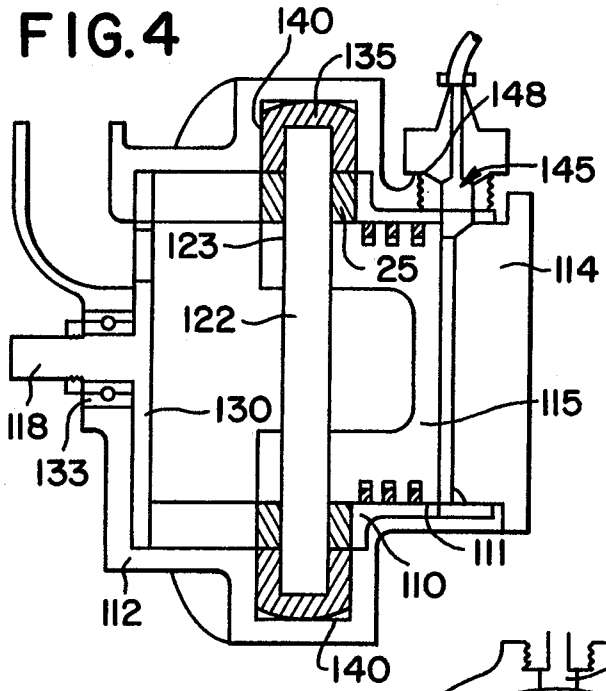

Ignition, in the embodiment shown in FIGS. 4 and 5, is by means of spark plug 158 in chamber 145 (see FIG. 11), as port 150A is next uncovered by a control port 152A or 152B at approximately top-dead-center (TDC), when the top of piston 115 is nearest head 114. This position of sleeve 110 is shown in FIG. 6A.

Figure 6B:
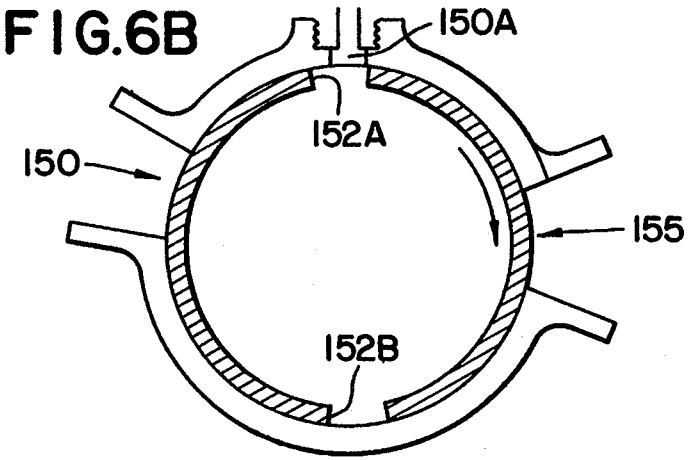
FIGS. 6A and 6B are progressive diagrammatic views, generally similar to FIG. 2, showing relative positions of the sleeve valve with respect to the porting in the housing.
Figure 6A:
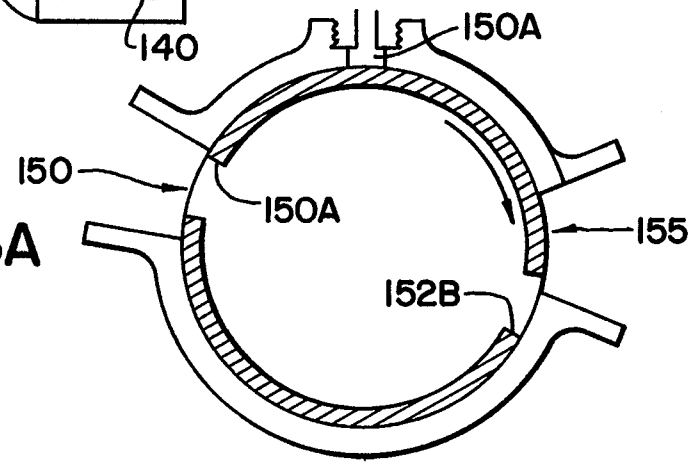

When combustion is complete and substantial expansion has occurred, control port 152A or 152B next uncovers exhaust port 155 at about 85° of sleeve rotation; see FIG. 6B. As one control port 152A begins to close exhaust port 155 the other port 152B begins to open intake port 150. By comparison of the angular extent of ports 152A, 152B and the space between the closing edge 155EC of exhaust port 155 and the opening edge 150EO of intake port 150, it will be noted that some overlap may be included during which both exhaust and intake ports are open. This overlap can be omitted or diminished to improve volumetric efficiency, by moving the ports 150 and 155 appropriately, narrowing sleeve port 152A and 152B, or a combination of these changes, all of which are known to persons skilled in the art of sleeve valve design, or by varying the profile of cam 140. Also, if additional intake and/or exhaust area is desired, the ports can be lengthened parallel to the axis of the cylinder.

Opposed Piston Engine

Figure 7:
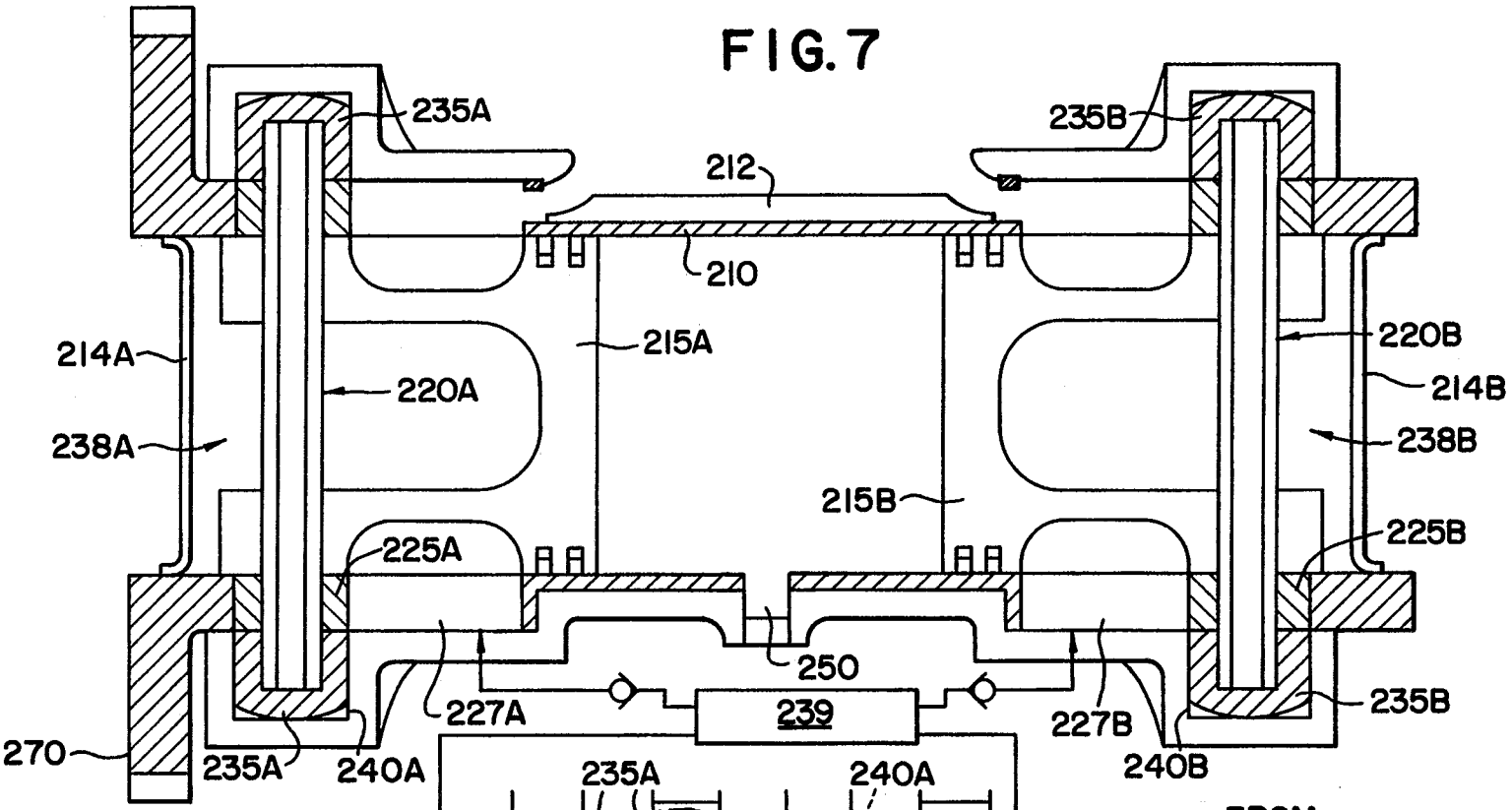
FIG. 7 is a longitudinal section illustrating the invention in the form of a compression-ignition engine with two opposed pistons.

FIG. 7 illustrates a dual opposed piston embodiment of an engine, built symmetrically with opposing pistons 215A and 215B and no cylinder head, and with separate cams 240A, 240B, cross-head mechanisms 220A and 220B, and followers 235A, 235B. Assuming complementary cam configurations this embodiment of engine is easily dynamically balanced without resort to other mechanism or devices for balancing purposes. This is another advantage over crank-type engine constructions.

The embodiment of FIG. 7 is shown in the form of a four-stroke compression ignition engine with opposed pistons 215A, 215B operating in a single sleeve cylinder 210, and is thus better balanced than the simpler, single-piston device of FIG. 1. The pistons, crossheads, cam followers and cams are essentially the same as the device shown in FIG. 1, but the cam configurations, cylinder apertures and ports may be modified. As previously noted, with two cycles to the cams, there are two complete piston strokes per revolution, but in this embodiment there is one power stroke of the opposed pistons per revolution.

As shown in FIG. 7, the volumes on the outer (cold) sides of pistons 215A, 215B can be used to pump air to the intake ports, providing a supercharging effect. These variable volumes or pumping chambers 238A, 238B are defined between the outermost ends of pistons 215A, 215B and end caps 214A, 214B which are fitted into sleeve 210. Access to/from chambers 238A, 238B is available through housing 212 and the slots 227A, 227B which provide guideways for the blocks 225A, 225B coupling the crosshead shafts or pins 220A, 220B to sleeve 210. Suitable check valves (shown schematically in FIG. 7) provide for compression of air into a reservoir 239 which in turn may provide air at above atmospheric pressure to charge the engine.

An additional difference from the FIG. 1 device is the provision of a gear 270 fixed to sleeve 210 in place of an output shaft. Gear 270 provides a convenient means for directly coupling rotary power to a load and/or to other power units. Thus, several power units can be geared together to provide more power and to smooth the torque fluctuations, and the combined rotating mass of the pistons, cross-head mechanisms and cylinder sleeve can obviate the need for a separate flywheel. As shown in FIG. 7, there are no separate shaft bearings, as the housing and cams provide axial and radial location for the cylinder/shaft. Obviously, distinct bearings may be provided if desired.

FIG. 7 shows pistons 215A, 215B at bottom dead center (BDC), at the end of a power stroke, with the aperture or control port 252A in the cylinder/sleeve 210 beginning to uncover the exhaust port.

Figure 9A:
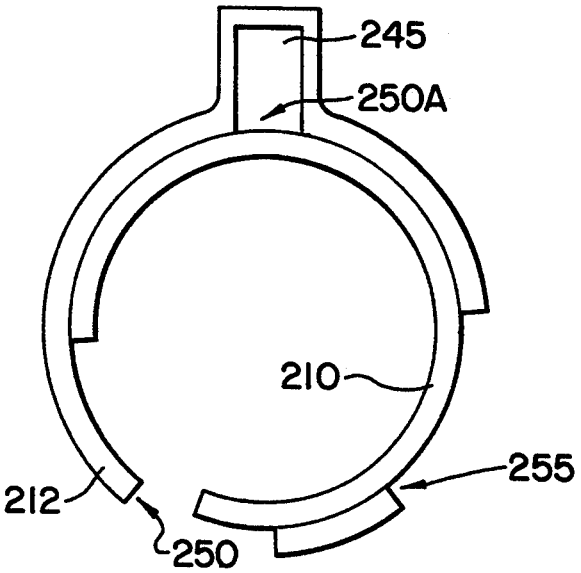
FIGS 9A–D comprise a succession of diagrammatic cross-sectional views showing the progressive action of the sleeve valving in the device shown in FIG. 7.
Figure 9B:
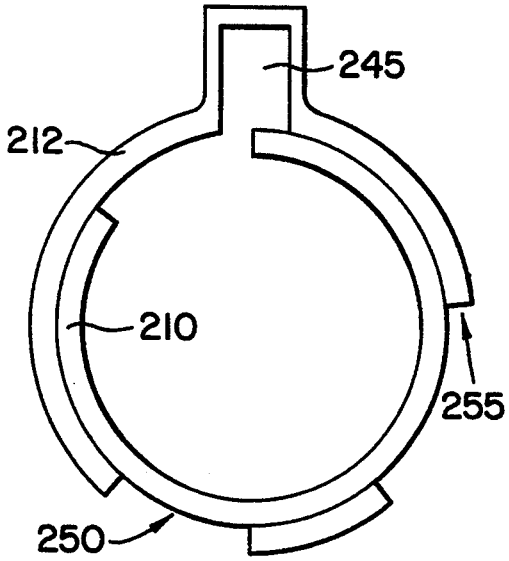

FIGS. 9A–D are schematic transverse sections depicting the arrangement of the intake port 250, the exhaust port 255, and the fuel chamber 245 which has a port 250A through which it can communicate with the interior of the cylinder through valve port 252. In FIG. 9A the pistons are at BDC, and sleeve port 252 is about to close intake port 250. A compression stroke follows and, shortly before piston TDC, the sleeve port 252 uncovers port 250 to chamber 245.

FIG. 10 shows details of the fuel chamber 245, which are essentially the same as described in connection with the embodiment of FIGS. 4, 5.

Preferably, the temperature should be high enough to partially pyrolyse the fuel, which greatly enhances ignition. Even though the fuel may be vaporized, pyrolysed, and at ignition temperature (three preconditions for proper combustion) combustion cannot take place until there is sufficient oxygen present.

When sleeve port 252 uncovers the fuel chamber port 250A toward the end of the compression stroke (see FIG. 9B) hot compressed air is injected into fuel chamber 245, providing oxygen to the hot fuel vapors already present therein. Ignition is prompt, followed by a rapid increase in temperature and pressure, and the burning fuel-air mixture is propelled through the ports into the cylinder, where complete combustion with an excess of oxygen occurs.

The ignition lag which is characteristic in direct-injected compression ignition engines is practically eliminated, permitting operation at higher speeds than are usual for diesel engines. At no time can cool fuel contact cool cylinder walls, so the incomplete combustion which sometimes causes conventional diesel engines to smell and smoke is considerably reduced.

Figure 9C:
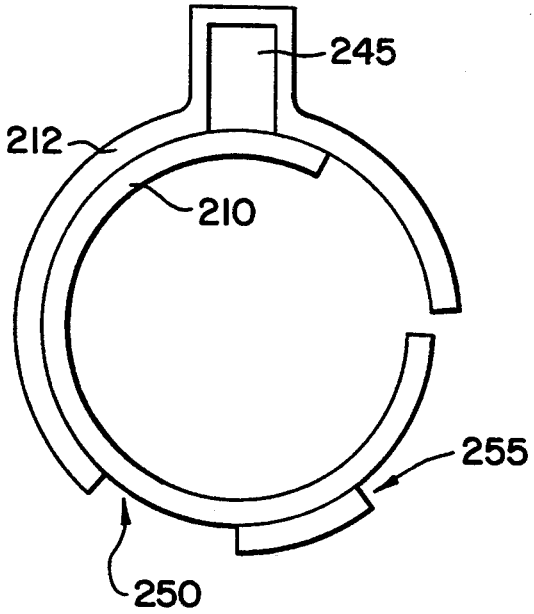
Figure 9D:
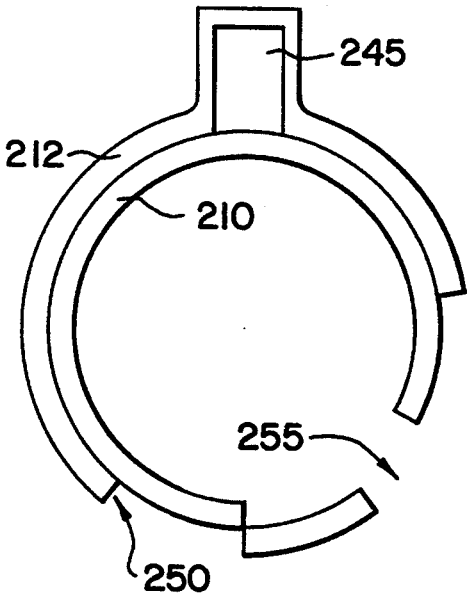

Sleeve valve 210 is shown at the end of the power stroke (BDC) in FIG. 9C, with exhaust port 255 beginning to be uncovered. As the cylinder/sleeve 210 rotates clockwise one quarter turn, the pistons 215A, 215B reach TDC, and exhaust port 255 will be closing as the intake port is opened; see FIG. 9D. The degree of overlap is determined by the sizes of the sleeve or control port 252 and the placement and size of exhaust and intake ports 255, 250 respectively.

It should be noted that, fuel chamber 250A was closed, and chamber 245 isolated, before exhaust port 255 was opened. As soon as the exhaust gasses are released, by the opening of port 255 there is a "blow down", a rapid expansion which cools the gaseous products of combustion as they flow from the cylinder. Isolating the fuel chamber 245 before such rapid cooling maintains the fuel chamber at a higher temperature and facilitates the heating and subsequent ignition of the incoming fuel. Fuel can begin to enter chamber 245, and for the next approximately 270° of sleeve rotation, the fuel will be warming and vaporizing in preparation for the next opening of chamber 245 (as in FIG. 9B).

Valve Controlled Fuel Chamber

Figure 11:
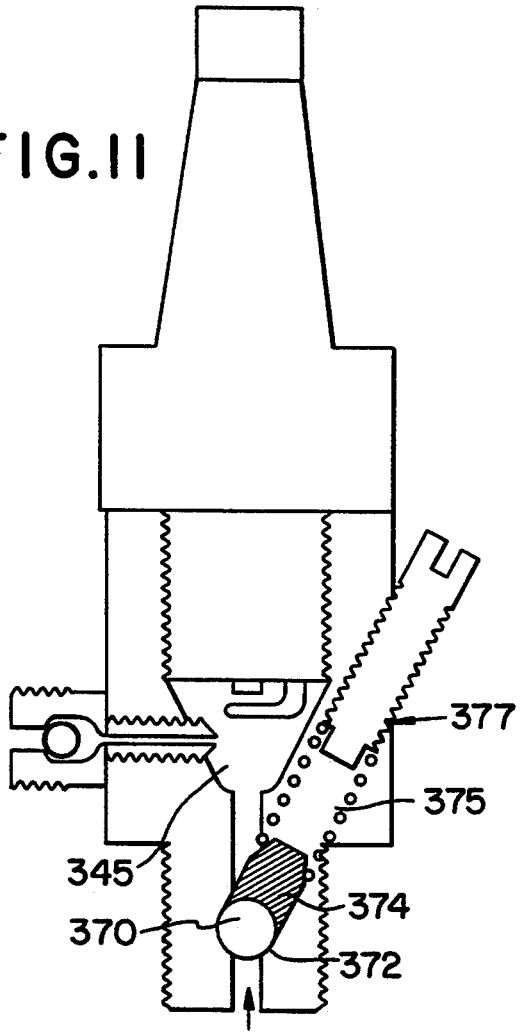
FIG. 11 is a view similar to FIG. 10 showing a modification of the fuel chamber arrangement.

As already noted, one of the features of the various forms of the invention as so far described is the partial shielding of the fuel chamber (or pre-combustion chamber) 45, 145, 245 from the engine cylinder during a substantial extent of the operating cycle. This principle can be extended to fuel pre-combustion chambers, as shown in FIG. 11, which shows a chamber 345 containing a spark plug (or glow plug) 364 and having a fitting to adapt chamber 345 to mounting in the spark plug aperture of a conventional engine, such as a ported two-cycle engine. To achieve the effect of the sleeve valve in the previous embodiments, chamber 345 has a spring loaded normally closed valve 370, preferably a ceramic ball or the like, which separates the interior of chamber 345 from the engine cylinder until compression pressure within the cylinder rises to a value sufficient to unseat valve 370. The ball valve 370 is pressed against its seat 372 by a slide 374 which is turn contacted by a compressed spring 375. An adjustment screw 377 provides a means to vary the compression of spring 375, to adjust the resistance to opening of ball 370.

When ball 370 does open, the pre-heated fuel in chamber 345 is exposed to the high temperature compressed gas in the engine cylinder, combustion quickly occurs and the ignited charge exits chamber 345 and flows rapidly into the engine cylinder where combustion is completed.

Three Piston Device

Figure 8:
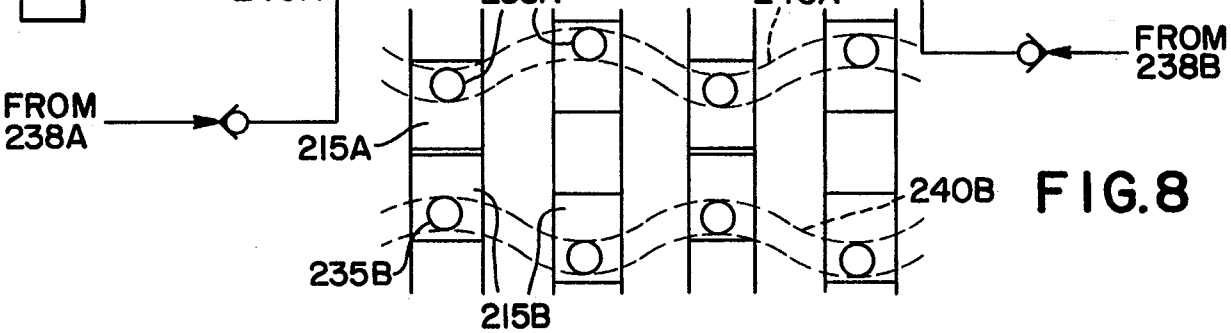
FIG. 8 is a sequential diagram showing the piston positions within the cylinder in the embodiment of FIG. 7.
Figure 12:
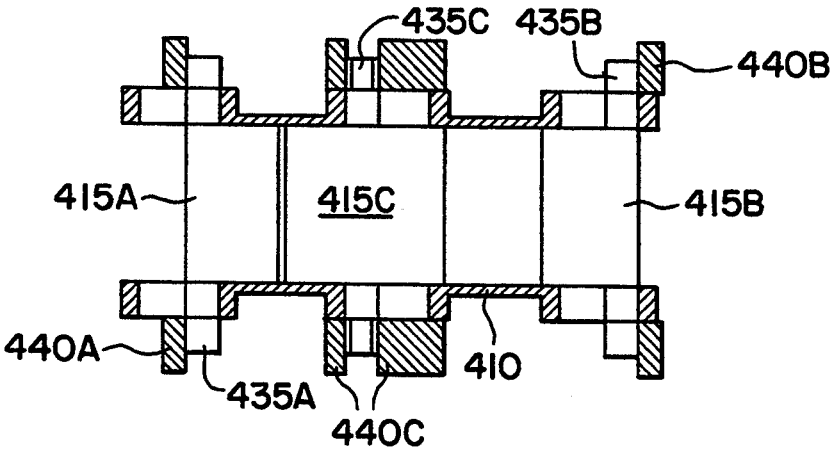
FIG. 12 is a schematic longitudinal sectional view through a three piston version of the device shown in FIG. 7.

FIG. 12 illustrates schematically a three piston version of the opposed piston engine described in connection with FIGS. 7–9. Pistons 415A and 415B, supported at opposite ends of a common sleeve 410, are controlled by respective cams 440A and 440B and followers 435A, 435B. A central piston 415C, of greater mass than the other two pistons, is supported between them and controlled by its cam 440C and followers 435C, so as to reciprocate between them and to define two axially aligned separate power cylinders within sleeve 410. The spaces of these cylinders expand and contract in opposition, and the cams can be constructed such that there are two power strokes or outputs, one from each cylinders per revolution of the sleeve and 90° out of phase.

Combinations of Modules

Figure 13:
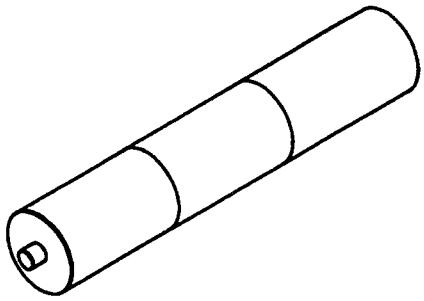
FIGS. 13–17 are diagrams illustrating different ways of coupling multiples of the modular unit into multi-cylinder devices.

Various combination of modules such as previously described can be achieved to multiply the output of the resulting units. For example, FIG. 13 shows schematically an arrangement of several modules according to the foregoing embodiments, connected in coaxial alignment to a common output shaft. In such an arrangement, the cam lobes of the individual modules can be arranged in appropriate phasing to distribute power outputs from the modules evenly over each revolution of the output shaft.

Figure 14:
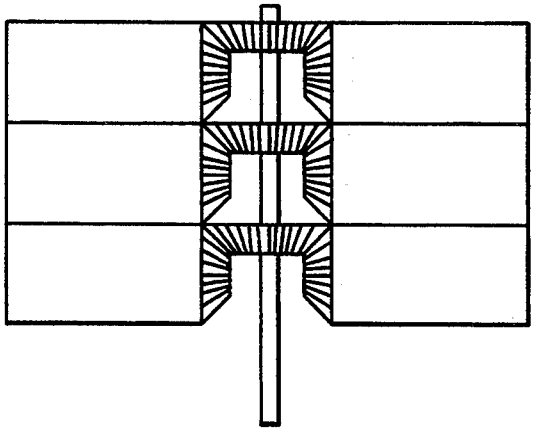
Figure 15:
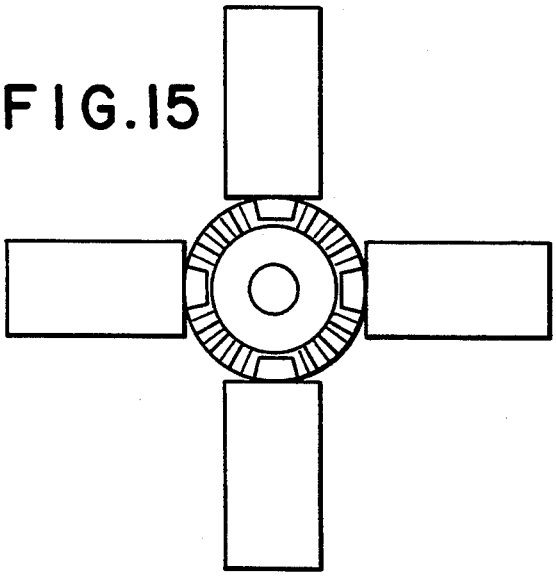

FIG. 14 shows schematically an in-line/opposed arrangement of modules connected to a common output shaft via bevel gears, and FIG. 15 shows a radial arrangement of modules connected to a common output gear and shaft through bevel gears.

Figure 16:
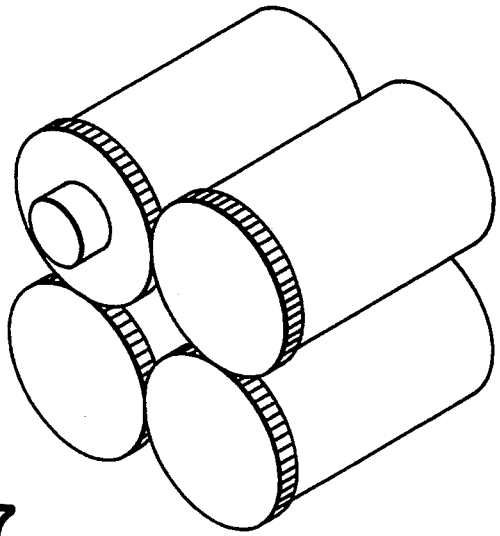
Figure 17:
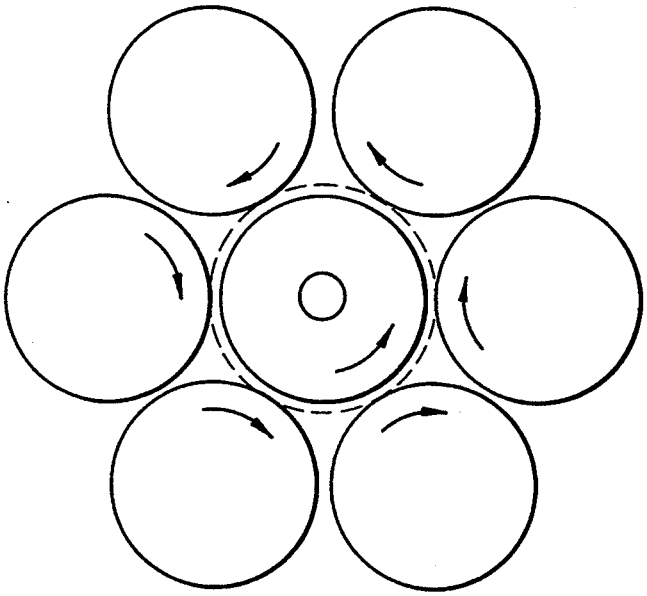

FIG. 16 shows diagrammatically the coupling of four modules through meshing spur gears (as in FIG. 7), one of which is connected to a common output shaft. FIG. 17 shows diagrammatically a "barrel" configuration of modules, with six modules surrounding a central module (or just a central output gear and shaft), all connected by spur gears.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. A rotary power device comprising:

a housing having a bore therein, a cylinder sleeve supported in said bore for rotary motion, at least one piston in said cylinder sleeve and axially reciprocable in said cylinder sleeve, said sleeve and said piston defining a variable volume power chamber, an annular cam supported on said housing co-axial with said cylinder sleeve and including at least two symmetrically disposed sinuous cam surfaces, cam followers supported from said piston and radially arranged with respect to said piston and contacting said cam surfaces to translate rotation of said followers along said cam surfaces of said cam into relative reciprocating motion between said piston and said cylinder sleeve, a crosshead supporting said followers and having a sliding connection means to said piston to constrain said piston to revolve with said cylinder sleeve and cam followers, an air inlet port, a fuel inlet port, and an exhaust port through said housing and into said bore, said ports being spaced around said bore separated from each other, cooperating apertures in said cylinder sleeve acting with said air inlet port, said fuel inlet port, and said exhaust port as a sleeve valve to admit air and fuel to said power chamber and to release products of combustion from said power chamber.

2. A rotary device as defined in claim 1, further including a rotary output member coupled to said cylinder sleeve providing a direct rotary power output from the device.

3. A rotary device as defined in claim 2, including a plurality of device modules having respective output gears which are coupled to a common rotary output member.

4. An engine comprising:

a housing having a bore therein, a cylinder sleeve supported in said bore for rotary motion, a first piston located in said cylinder sleeve and axially reciprocable in said cylinder sleeve, cam means supported on said housing co-axial with said cylinder sleeve, and cam follower means radially arranged with respect to said piston and supported from said piston, said follower means contacting said cam means to translate rotation of said follower means along said cam means into relative reciprocating motion between said piston and said cylinder sleeve, a crosshead supporting said follower means and having a sliding connection means to said piston to constrain said piston to revolve with said cylinder sleeve and follower means, an air inlet port, a fuel inlet port, and an exhaust port through said housing and into said bore, said ports being spaced around said bore separated from each other, cooperating apertures in said cylinder sleeve acting with said air inlet port, said fuel inlet port, and said exhaust port as a sleeve valve to admit air and then fuel in combustible charges into said cylinder sleeve and to exhaust products of combustion from said cylinder sleeve.

5. An engine as defined in claim 4, further including coupling means for extracting rotary power from said sleeve as said sleeve rotates during operation of the engine.

6. An engine as defined in claim 4, further including a second piston in said cylinder sleeve, said pistons having facing heads forming a combustion chamber between them and within said sleeve, and second cam means and second follower means controlling the reciprocation of said second piston in opposition and in phase relation to said first piston.

7. An engine as defined in claim 6, further including a third piston in said sleeve between said first and second pistons, and third cam means and third follower means controlling the reciprocation of said third piston with respect to said first and second pistons.

8. An engine as defined in claim 4, further including a fuel chamber extending from said housing at said fuel inlet port communicating said fuel chamber to said cylinder sleeve, said port cooperating with said apertures in said sleeve to control passage of a fuel charge from said chamber into said sleeve, and means for supplying fuel into said fuel chamber while said chamber is closed by said sleeve to form a rich non-combustible fuel charge in said chamber.

9. An engine as defined in claim 8 further including an ignition device in said fuel chamber and operative when said chamber is opened into said sleeve to ignite the resulting combustible charge resulting from discharge of the rich fuel charge from said fuel chamber into said sleeve.

10. An engine as defined in claim 4, there being a plurality of devices each including a housing, sleeve, piston, cam and follower mechanisms, further including a common output member coupled to each of said sleeves to synchronize the operation and rotary power output of the multiple devices.

11. A method of transferring power from a piston-cylinder device comprising:

the device having a housing with a bore therein, a cylinder sleeve sleeve supported in the bore for rotary motion, and at least one piston in the cylinder and axially reciprocable in said cylinder sleeve, the sleeve and piston defining a variable volume power chamber, the housing having an air inlet port, a fuel inlet port, and an exhaust port, the ports being spaced around the housing, providing an annular cam co-axial with the cylinder sleeve and including at least two symmetrically disposed sinuous cam surfaces, and providing cam followers radially arranged on the piston and contacting the cam surfaces to translate rotation of the followers along the cam into reciprocating motion between the piston and the cylinder sleeve, and providing a sliding connection between the piston and the cylinder sleeve to constrain the piston to revolve with the cylinder sleeve and cam followers, the cylinder sleeve having cooperating apertures acting with the air inlet port, fuel inlet port, and exhaust port, the sleeve acting as a sleeve valve to admit and exhaust gaseous fluid to and from the power chamber through cooperating ports in the cylinder sleeve and housing, whereby rotary power can be extracted from the cylinder sleeve.

* * * * *